US007753205B2

(12) United States Patent
Shibata et al.

(10) Patent No.: US 7,753,205 B2
(45) Date of Patent: Jul. 13, 2010

(54) PACKAGING CONTAINER

(75) Inventors: Yasuhiro Shibata, Okazaki (JP); Teruo Imamaki, Nissin (JP); Takashi Miki, Nagoya (JP); Susumu Murata, Toyoake (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 12/077,642

(22) Filed: Mar. 20, 2008

(65) Prior Publication Data

US 2008/0245694 A1 Oct. 9, 2008

(30) Foreign Application Priority Data

Apr. 6, 2007 (JP) ..... 2007-101050

(51) Int. Cl.
*B65D 73/00* (2006.01)

(52) U.S. Cl. ..... 206/469; 229/926; 229/927

(58) Field of Classification Search ..... 206/469, 206/470, 471, 467, 461; 229/924, 926, 927, 229/406

See application file for complete search history.

(56) References Cited

U.S. PATENT DOCUMENTS

| | | | | |
|---|---|---|---|---|
| 3,197,120 | A | 7/1965 | Sparks | |
| 4,266,666 | A * | 5/1981 | Kuchenbecker | 206/461 |
| 4,574,951 | A * | 3/1986 | Weaver | 206/461 |
| 4,739,883 | A * | 4/1988 | Mohs et al. | 206/470 |
| 5,009,894 | A * | 4/1991 | Hsiao | 424/451 |
| 5,209,354 | A * | 5/1993 | Thornhill et al. | 206/469 |
| 5,443,154 | A * | 8/1995 | Hustad et al. | 206/213.1 |
| 5,447,232 | A * | 9/1995 | Chow | 206/378 |
| 5,788,105 | A * | 8/1998 | Foos | 220/266 |
| 6,155,414 | A * | 12/2000 | Vaessen | 206/232 |
| 6,213,303 | B1 * | 4/2001 | Harris et al. | 206/581 |
| 6,227,369 | B1 | 5/2001 | Glassman | |
| 6,364,114 | B1 * | 4/2002 | Glassman | 206/469 |
| 6,920,980 | B2 * | 7/2005 | Hwang et al. | 206/470 |
| 7,389,907 | B2 * | 6/2008 | Smith | 229/87.05 |
| 2006/0096886 | A1 * | 5/2006 | Morrison | 206/703 |
| 2006/0278551 | A1 | 12/2006 | Bianchini | |
| 2007/0095848 | A1 * | 5/2007 | Galland et al. | 220/784 |

FOREIGN PATENT DOCUMENTS

| | | |
|---|---|---|
| GB | 1914 15698 | 2/1915 |
| JP | 2002128140 | 9/2002 |
| WO | WO 2006/102210 A | 9/2006 |

* cited by examiner

*Primary Examiner*—Jacob K Ackun, Jr.
(74) *Attorney, Agent, or Firm*—Day Pitney LLP

(57) ABSTRACT

A packaging container includes a first clamshell half, a second clamshell half, a connecting portion that connects an edge of the first clamshell with an edge of the second clamshell half, a sealed portion that fastens the first clamshell and the second clamshell to each other, the sealed portion being located at the edge of the packaging container on a side opposite to the connecting portion, and a severed portion that is provided in at least one of the first clamshell and the second clamshell between the sealed portion and a packaged object, which is accommodated in a room created between the first clamshell and the second clamshell when the clamshell halves are fitted to each other, and that is severed off for opening the packaging container.

3 Claims, 14 Drawing Sheets

PACKAGING CONTAINER

CROSS-REFERENCE TO RELATED APPLICATION

This Application claims priority from JP2007-101050, filed Apr. 6, 2007, the entire disclosure of which is incorporated herein by reference thereto.

BACKGROUND

The present disclosure relates to a packaging container and particularly to a packaging container that accommodates a packaged object in a room defined between a first clamshell and a second clamshell half, which fit to each other.

Clamshell packaging has been known as a general packaging form that enables shops to hang products for sale such as stationery, small electrical devices, dry cell batteries and memory card in good-looking manners. Many clamshell packaging cases are transparent for making the products accommodated inside highly visible, and, in addition, they offer high degrees of security in protecting the products.

Furthermore, for providing users easy access to the product accommodated in the clamshell packaging case after their purchase, there is a suggestion that a line of perforations be provided in the rear side of the clamshell packaging case around the accommodated object (refer to, for example, Japanese Laid-Open Patent Publication No. 2002-128140). The clamshell packaging case disclosed in Japanese Laid-Open Patent Publication No. 2002-128140 enables a user to open the packaging case by tearing it along the line of perforations without using a tool like scissors or a cutter.

SUMMARY

The clamshell packaging case disclosed in Japanese Laid-Open Patent Publication No. 2002-128140 enables a user to open the packaging case by tearing it along the line of perforations, which is provided around the accommodated object, and to take the object out. However, it is not easy for the user just by hand to sever the packaging case neatly along the line of perforations. As a result, it has been a problem that, while the user is tearing the packaging case along the line of perforations, the packaging case can break off in an unintended direction away from the line of perforations. Another problem has been that the tearing of the packaging case along the line of perforations can form a sharp edge even if the packaging case itself is opened successfully along the line of perforations.

The present disclosure is to solve the above mentioned problems, and the object of the present disclosure is to provide a clamshell packaging container that enables easy and safe manual opening.

For solving the above problems, a packaging container according to a first aspect of the disclosure comprises a first clamshell half, a second clamshell half, a connecting portion that connects an edge of the first clamshell half with an edge of the second clamshell half, a sealed portion that fastens the first clamshell half and the second clamshell half to each other, the sealed portion being located at the edge of the packaging container on a side opposite to the connecting portion, and a severed portion that is provided in at least one of the first clamshell half and the second clamshell half between the sealed portion and a packaged object, which is accommodated in a room created between the first clamshell half and the second clamshell half when the clamshell halves are fitted to each other, and that is severed off for opening the packaging container.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

Figure 1:
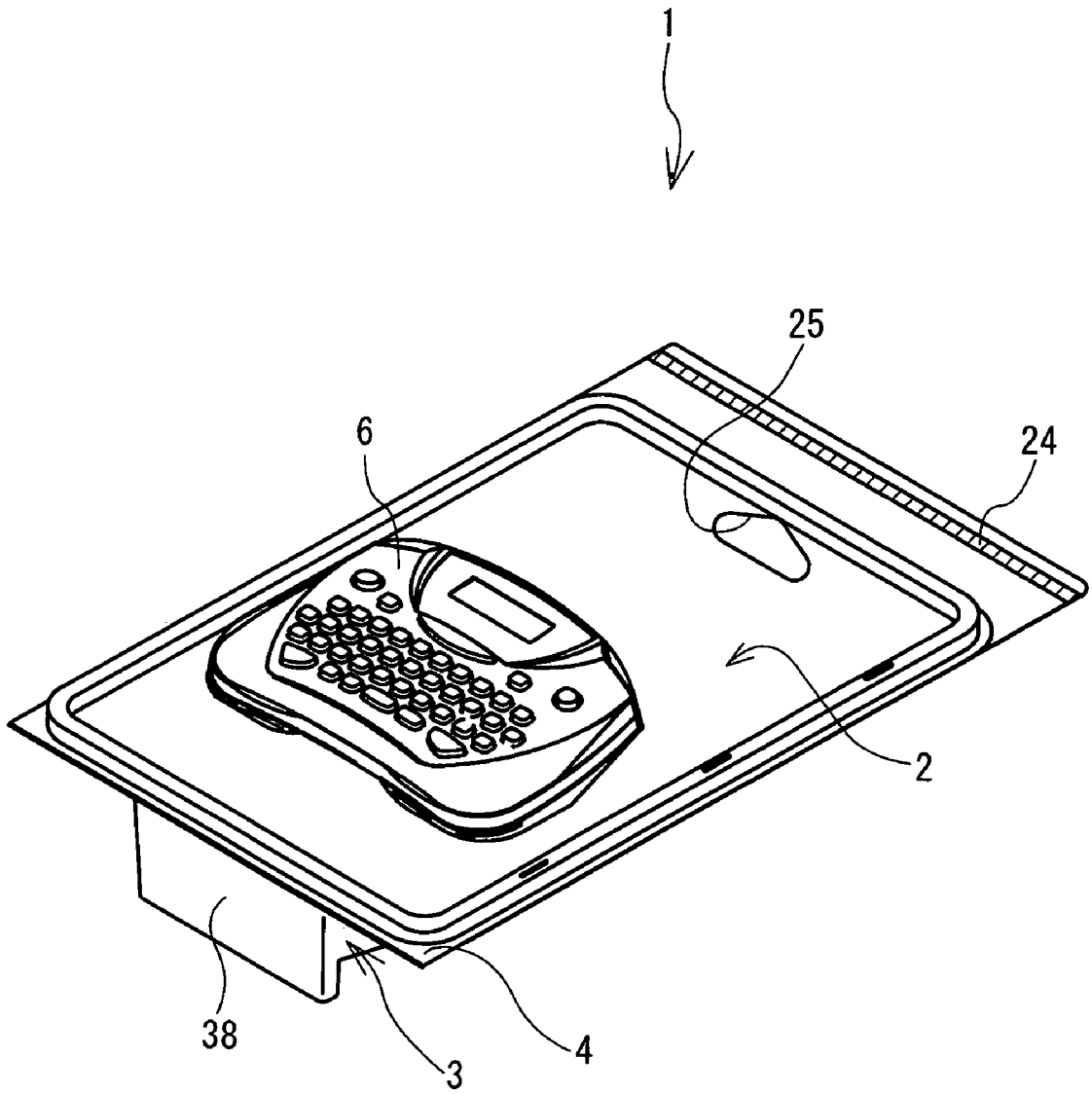
FIG. 1 is a perspective view of a clamshell packaging case.

Now, a clamshell packaging case 1, which is one embodiment of the present disclosure, is described in reference to FIGS. 1-4.

At first, the structural outline of the clamshell packaging case 1 is described in reference to FIGS. 1-4. As shown in these drawings, the clamshell packaging case 1 is a vertically rectangular packaging container in front view, and it is transparent because its material is a synthetic resin such as polyethylene terephthalate, vinyl chloride or polystyrene. The clamshell packaging case 1 accommodates, for example, a small electronic product like a tape printer 6, stationary, an electronic calculator, a dry cell battery or a memory card, and the packaged product is hung from a rack of a store for sale.

The clamshell packaging case 1 comprises a first clamshell 2 and a second clamshell 3, which are connected to each other by a foldable fold part 4 and are to fit to each other. The first clamshell 2 is vertically rectangular in front view and constitutes the front face of the clamshell packaging case 1. The second clamshell 3 is also vertically rectangular in front view and constitutes the rear face of the clamshell packaging case 1.

Figure 4:
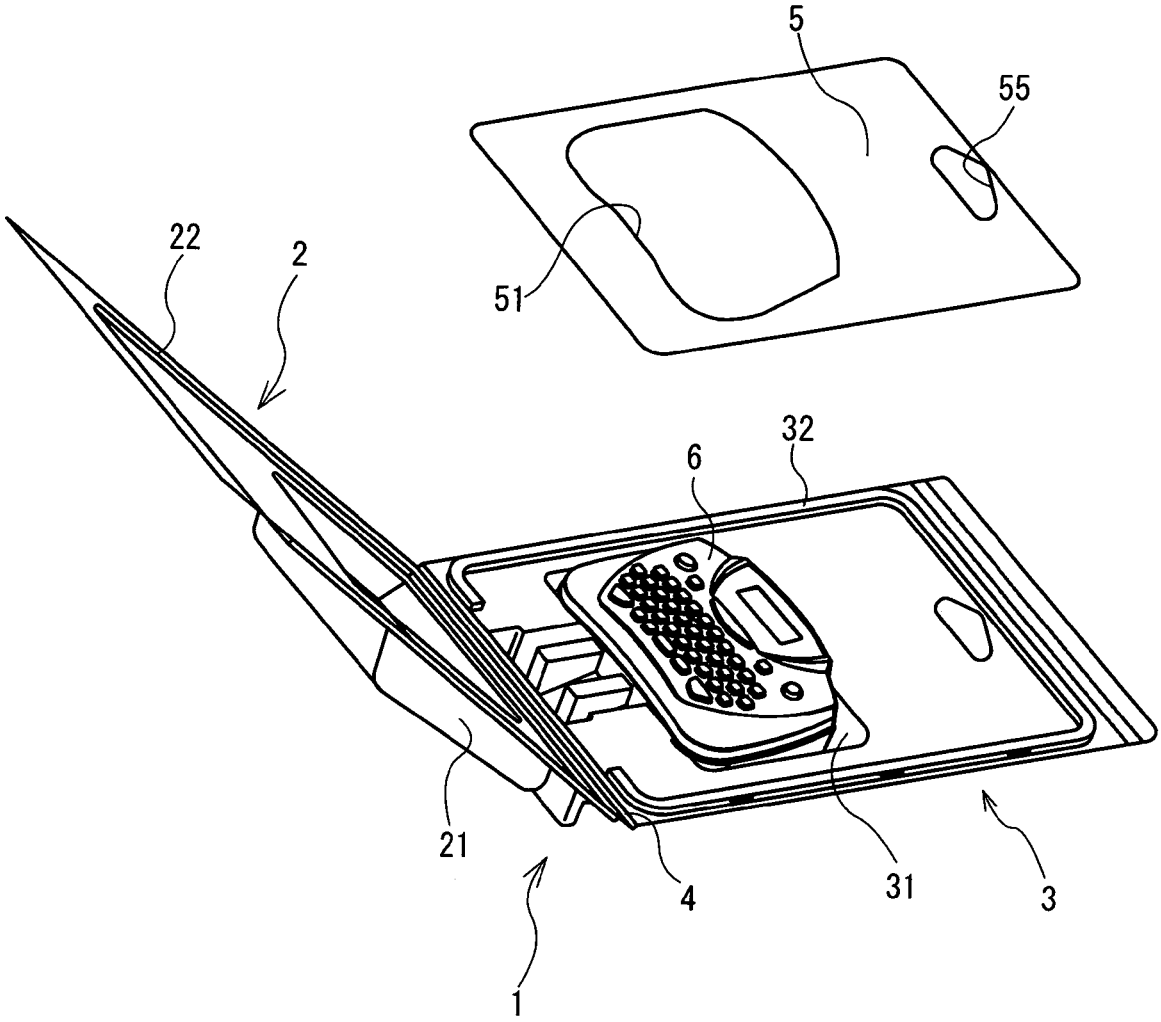
FIG. 4 is a perspective view of the clamshell packaging case in its opened condition.

As shown in FIG. 4, an object to be packaged, for example, a tape printer 6, is placed between the first clamshell 2 and the second clamshell 3. In addition to the packaged object, a card board 5, which carries on its front and rear faces a description and an advertisement of the product can be placed together. The card board 5 has an opening 51, through which the packaged object, i.e., the tape printer 6, can pass, and another opening 55, through which a hook (not shown) for hanging the package from a sale rack can pass. Then, the first clamshell 2 and the second clamshell 3 are sealed at a sealed part 24 as shown in FIG. 1.

As described above, in principle, a packaged object with a card board 5 is sandwiched between the first clamshell 2 and the second clamshell 3, which are then sealed at the sealed part 24 for completing the clamshell packaging case 1, enclosing the packaged object. Furthermore, for making the sealing of the first clamshell 2 and the second clamshell 3 more secure, it is preferable that the first clamshell 2 and the second clamshell 3 be made to fit into each other. Therefore, the first clamshell 2 and the second clamshell 3 that include fitting parts to fit each other are detailed in the following.

Figure 2:
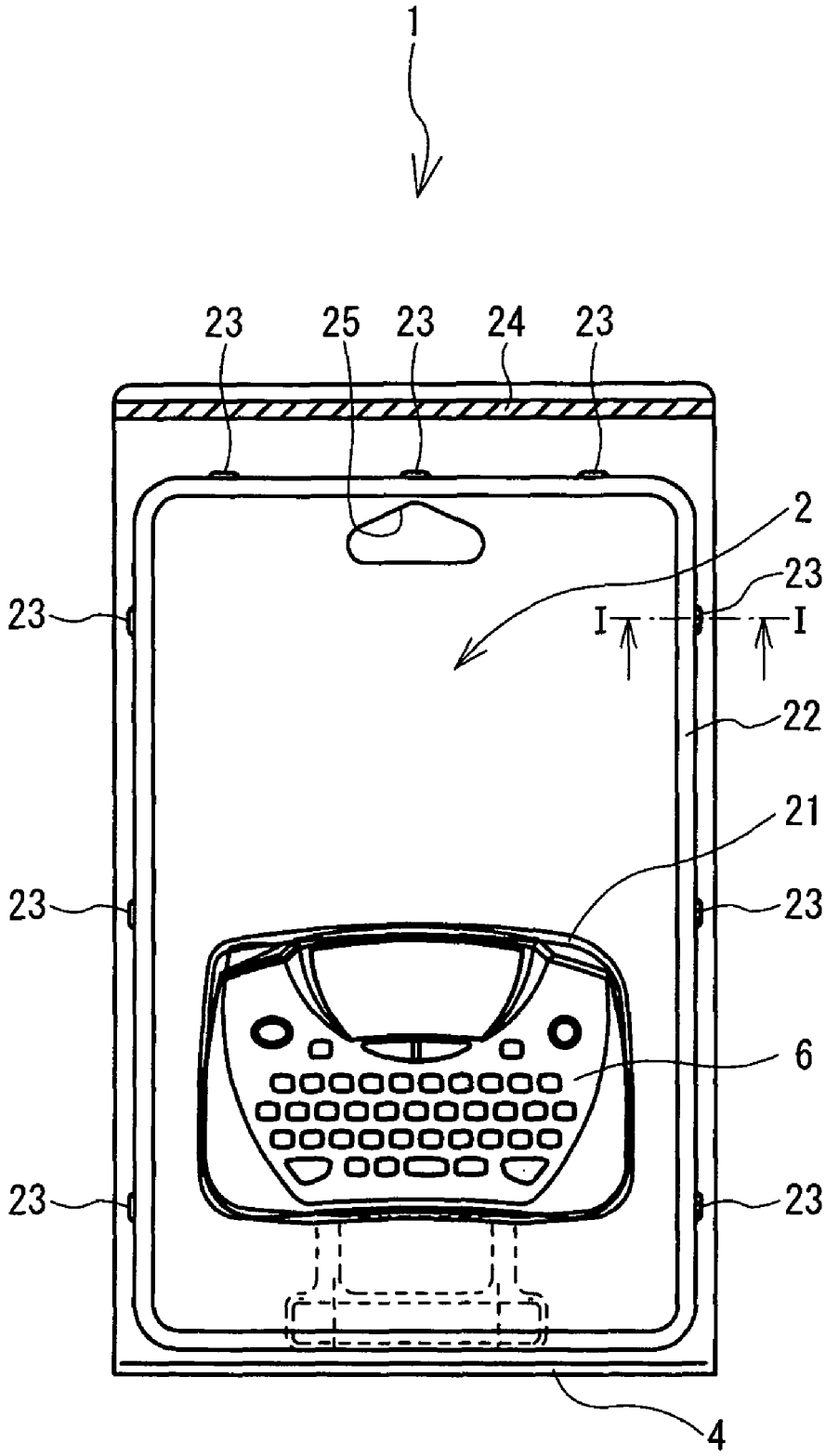
FIG. 2 is a front view of the clamshell packaging case.

Now, the structure of the first clamshell 2 is described in reference to FIG. 2 and FIG. 4. The first clamshell 2 is a transparent case made of a synthetic resin such as polyethylene terephthalate, and it has a vertically rectangular form in front view as shown in these drawings. In addition, the first clamshell 2 has a first storage space 21 at its lower part in front view for accommodating a packaged object, i.e., a tape printer 6. The first storage space 21 protrudes outward, but it is recessed if viewed from the inside of the first clamshell 2, and the first storage space 21 has a capacity that can accommodate the upper half of the packaged object, i.e., the tape printer 6.

In addition, the first clamshell 2 is provided with a fitting groove 22 inwardly adjacent to and along the circumference, or as illustrated in FIG. 2, the perimeter of the first clamshell 2. The fitting groove 22 is laid out in a rectangle in front view, and it has a "U" shape in cross-sectional view. The fitting groove 22 is recessed if viewed from the inside of the first clamshell 2 but is raised if viewed from outside. Furthermore, the fitting groove 22 is provided with engaging concave parts 23 in the inner wall on the upper side, the right side and the left sides of the fitting groove 22 as shown in FIG. 2, three of them on each side. Each engaging concave part is recessed in a "U"-shape in cross-sectional view, has a predetermined length. Moreover, the first clamshell 2 is provided with an opening 25 at a position below the upper part of the fitting groove 22 as shown in FIG. 2, which opening is for a hook (not shown), which is used for hanging the package from a rack for sale. In addition, the first clamshell 2 is provided with a sealed part 24 above and along the upper part of the fitting groove 22 and in parallel with the upper edge of the first clamshell 2, the sealed part 24 extending linearly with a predetermined width. After the first clamshell 2 and the second clamshell 3 are fittingly joined to each other, the sealed part 24 of the first clamshell 2 is welded to the corresponding part of the second clamshell 3 by heating or supersonic wave.

Figure 3:
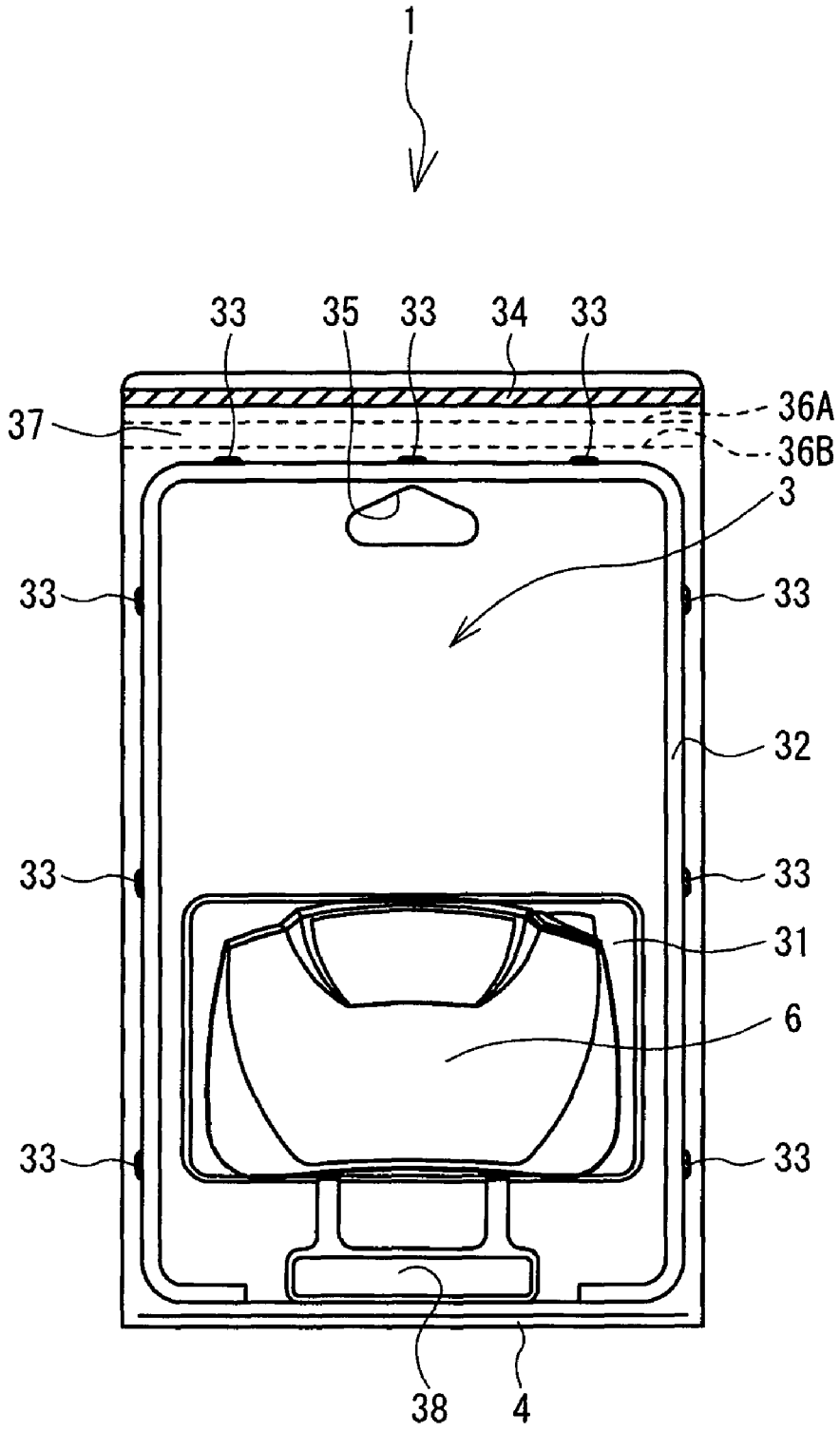
FIG. 3 is a rear view of the clamshell packaging case.

Now, the structure of the second clamshell 3 is described in reference to FIGS. 3 and 4. The second clamshell 3 is a transparent case made of a synthetic resin such as polyethylene terephthalate, and it has a vertically rectangular form in front view as shown in these drawings. In addition, the second clamshell 3 has a second storage space 31 at its lower part in front view for accommodating the packaged object, i.e., the tape printer 6. The second storage space 31 protrudes outward, but it is recessed if viewed from the inside of the second clamshell 3, and the second storing space 31 has a capacity that can accommodate the lower half of the packaged object, i.e., the tape printer 6.

In addition, the second clamshell 3 is provided with a fitting convex part 32 inwardly adjacent to and along the circumference of the second clamshell 3. The fitting convex part 32 has an inverted "U"-shape in cross-sectional view, and it is laid out in a rectangle in front view in such a way that the fitting convex part 32 is raised if viewed from the inside (front side) of the second clamshell 3 but is recessed if viewed from the outside (rear side). Furthermore, the fitting convex part 32 is provided with engaging convex parts 33 on the outer wall on the upper side, the right side and the left sides of the fitting convex part 32 as shown in FIG. 3, three of them on each side. Each engaging convex part 33 is raised in an inverted "U"-shape in cross-sectional view, and it has a predetermined length and a height, which configuration enables each engaging convex part to fittingly enter an above described corresponding engaging concave part 23. Moreover, the second clamshell 3 is provided with an opening 35 at a position below the upper part of the fitting convex part 32 as shown in FIG. 3, which opening is for a hook (not shown), which is used for hanging the package from a rack for sale. In addition, the second clamshell 3 is provided with a sealed part 34 above and along the upper part of the fitting convex part 32 and in parallel with the upper edge of the second clamshell 3, the sealed part 34 extending linearly with a predetermined width. After the first clamshell 2 and the second clamshell 3 are fittingly joined to each other, the sealed part 34 of the second clamshell 3 is welded to the sealed part 24 of the first clamshell 2 by heating or supersonic wave.

Moreover, the second clamshell 3 is provided with two lines of perforations 36A, 36B at a position between the sealed part 34 and the fitting convex part 32 and adjacent to and in parallel with the sealed part 34 as shown in FIG. 3. The part delimited by these two lines of perforations 36A, 36B is a severed part 37. By the way, the severed part 37 does not need to be arranged in parallel to the sealed part 34 as long as it is positioned sufficiently adjacent to the sealed part 34 to prevent the second clamshell 3 from coming off from the first clamshell 2 while the severed part 37 is still being pulled and severed for opening the clamshell packaging case.

As shown in FIGS. 1 and 3, the second clamshell 3 is also provided with a foot-like support 38 at the lower part thereof (in FIG. 3). The foot-like support 38, which protrudes with a predetermined width and a predetermined height, supports the clamshell packaging case 1 when the clamshell packaging case is placed on a flat surface.

Figure 5:
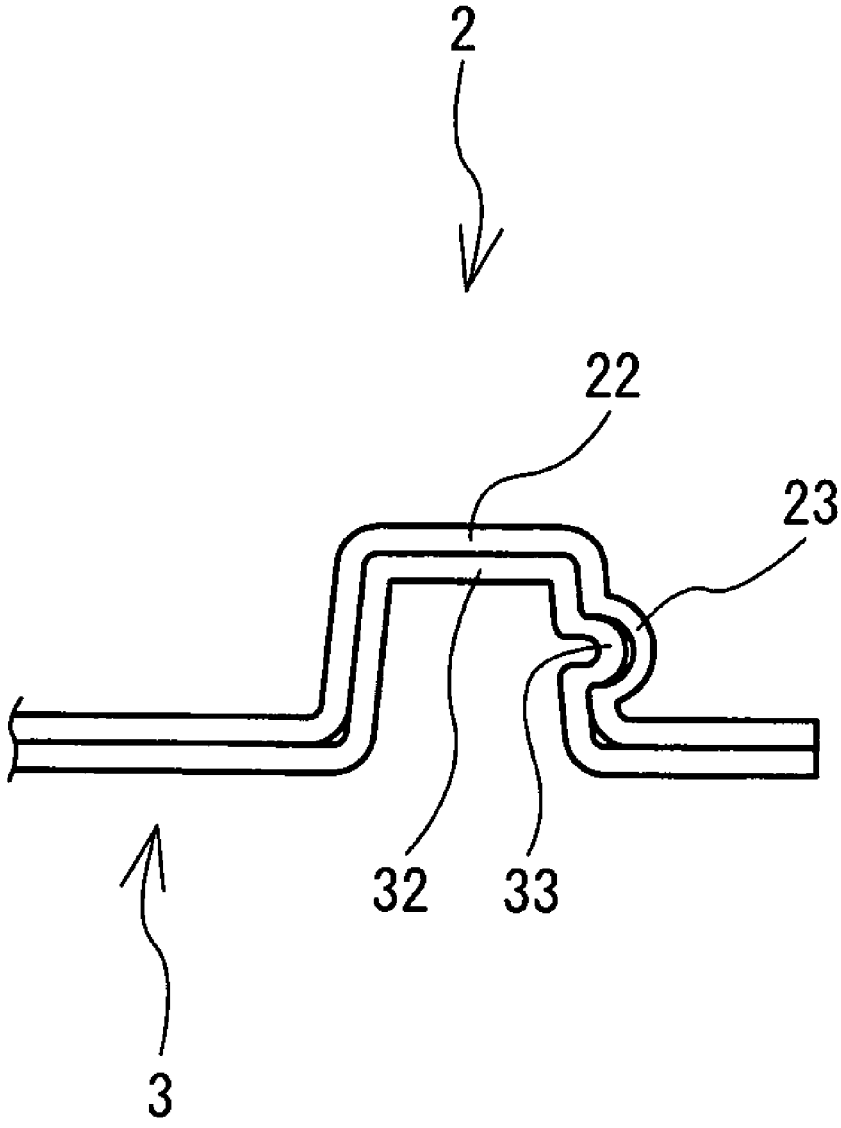
FIG. 5 is a cross-sectional view taken along line I-I in the direction indicated by arrows in FIG. 2.

Now, the fitting of the engaging concave parts 23 of the first clamshell 2 and the engaging convex parts 33 of the second clamshell 3 is described in reference to FIG. 5. When the first clamshell 2 and the second clamshell 3 are brought to fit into each other, all the engaging convex parts 33, which are provided on the fitting convex part 32 of the second clamshell 3, come into fittingly contact with all the engaging concave parts 23, which are provided in the fitting groove 22 of the first clamshell 2, as shown in FIG. 5. In the condition where the engaging convex parts 33 and the engaging concave parts 23 are fittingly fixed to each other, the first clamshell 2 and the second clamshell 3 are also fixed to each other, preventing even their right and left sides from being opened. In other words, after the sealed parts 24, 34 of the first clamshell 2 and the second clamshell 3 are welded to each other at the edge located on the side opposite to where the fold part 4 is located, the clamshell packaging case 1 is securely closed even at its right and left edges because the first clamshell 2 and the second clamshell 3 are fittingly fixed by the provision of the engaging concave parts 23 and the engaging convex parts 33.

Figure 6:
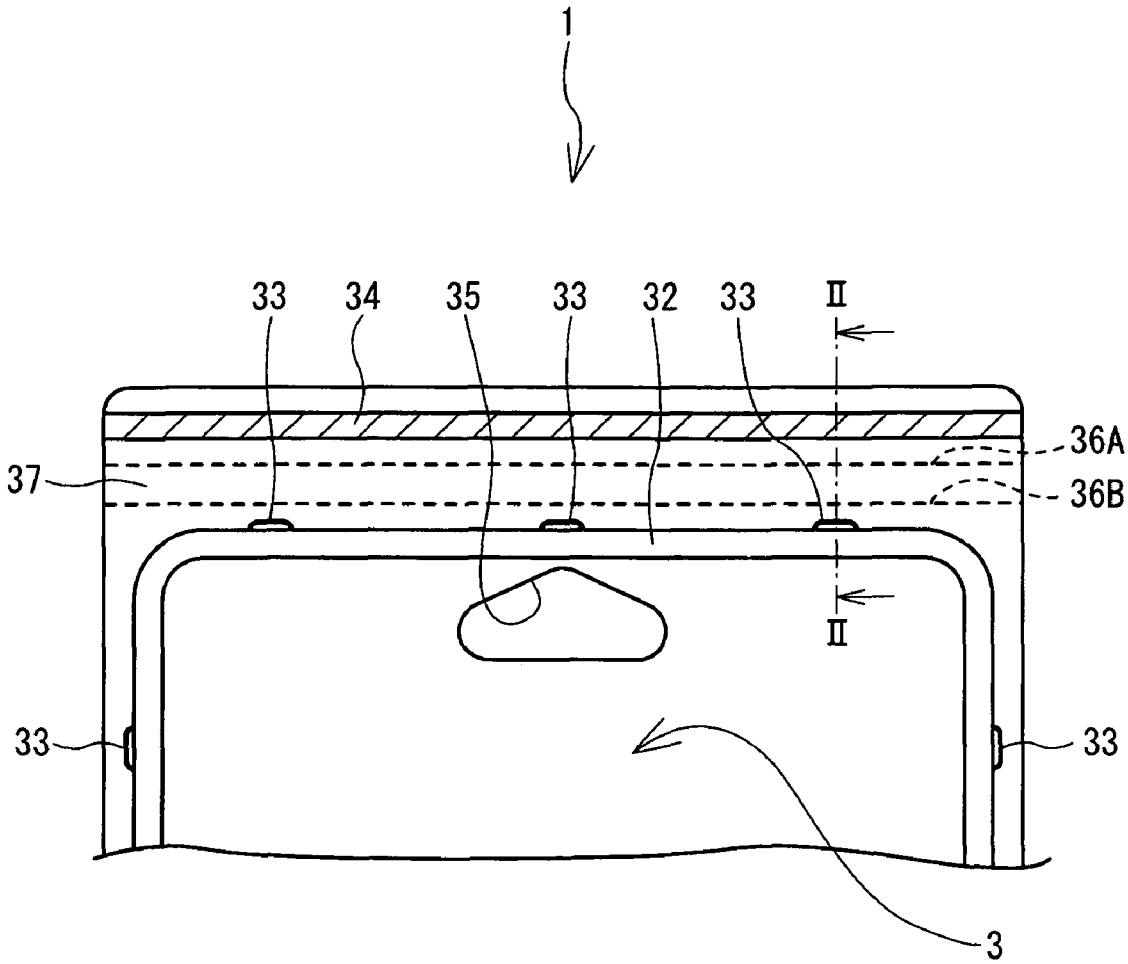
FIG. 6 is an enlarged partial view of an upper part of the rear side (second clamshell half) of the clamshell packaging case.
Figure 7:
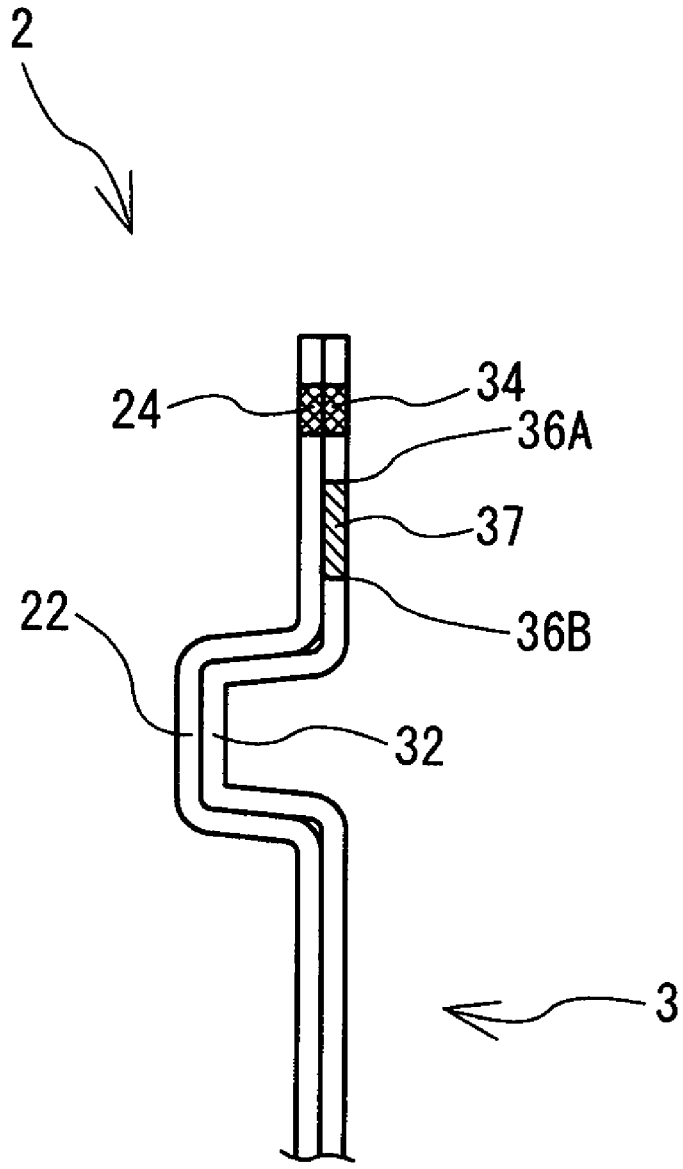
FIG. 7 is a cross-sectional view taken along line II-II in the direction indicated by arrows in FIG. 6, showing a fitted condition where the fitting groove of the first clamshell and the fitting convex part of the second clamshell are fitted with each other and sealed condition.
Figure 8:
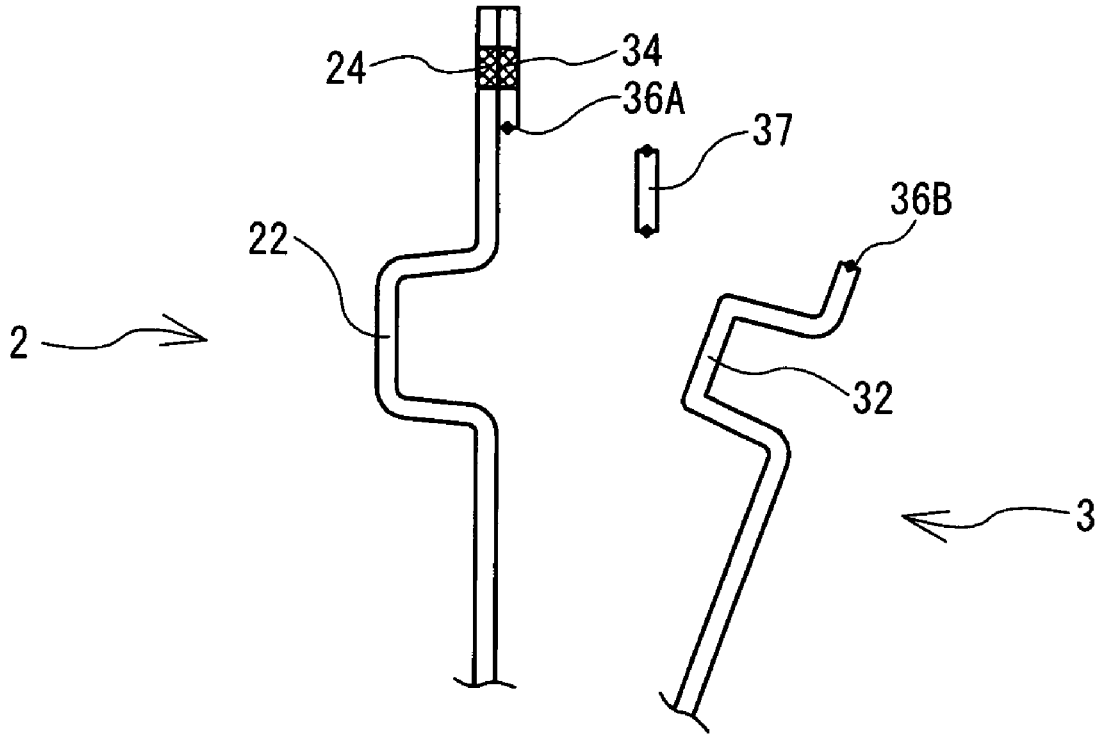
FIG. 8 is a cross-sectional view showing a condition where the fitting groove of the first clamshell and the fitting convex part of the second clamshell are disengaged from each other.

Now, the opening of the clamshell packaging case 1, which has the above described structure, is described in reference to FIGS. 6-8.

As shown in FIGS. 6 and 7, the severed part 37 is the part delimited by the two lines of perforations 36A, 36B, which are provided in parallel with the sealed part 34 and adjacent to the upper edge of the second clamshell 3, which constitutes the rear face of the clamshell packaging case 1. When the user takes hold of either one of the right and left ends of the severed part 37 with his fingers and lifts it and pulls it toward the other end, the severed part is cut off along the lines of perforations 36A and perforations 36B as shown in FIG. 8. After the removal of the severed part 37, the user pulls the second clamshell 3 away from the first clamshell 2, disengaging one from the other for opening the clamshell packaging case 1. Then, the user takes out the packaged object, i.e., the tape printer 6. As shown in FIG. 8, even after the removal of the severed part 37, part that had formed the perforations 36A of the second clamshell 3 still remains on the flat part of the first clamshell 2 (where the flat face of the first clamshell 2 is in contact with the flat face of the second clamshell 3). Therefore, this remaining part of the perforations 36A never projects into the fitting groove 22 and never acquires a form of saw blade, so safety is maintained. Furthermore, the removal of the severed part 37 can be performed in a clean manner because the severed part 37 is provided adjacent to the sealed part 34. The two lines of perforations, which are provided in parallelism, make the pulling force applied on the severed part 37 act evenly on both the edges of the severed part 37. As a result, the severed part 37 is cut through neatly without any break. Furthermore, since the severed part 37 is provided in the second clamshell 3, which constitutes the rear side of the clamshell packaging case 1, the first clamshell 2, which constitutes the front side, is kept good-looking for front side without disturbance, so it is still suitable for advertisement use. By the way, the second clamshell 3 may be provided with both the lines of perforations 36A, 36B or at least one line of perforations 36A at a position that comes into contact with the flat part of the first clamshell 2. The clamshell packaging case 1, which has the above described structure, is produced in a one-piece body that comprises the first clamshell 2 and the second clamshell 3 by vacuum forming, in which process, a sheet of a synthetic resin is heated to a forming temperature, stretched onto a mold, and held against the mold by applying vacuum.

Figure 9:
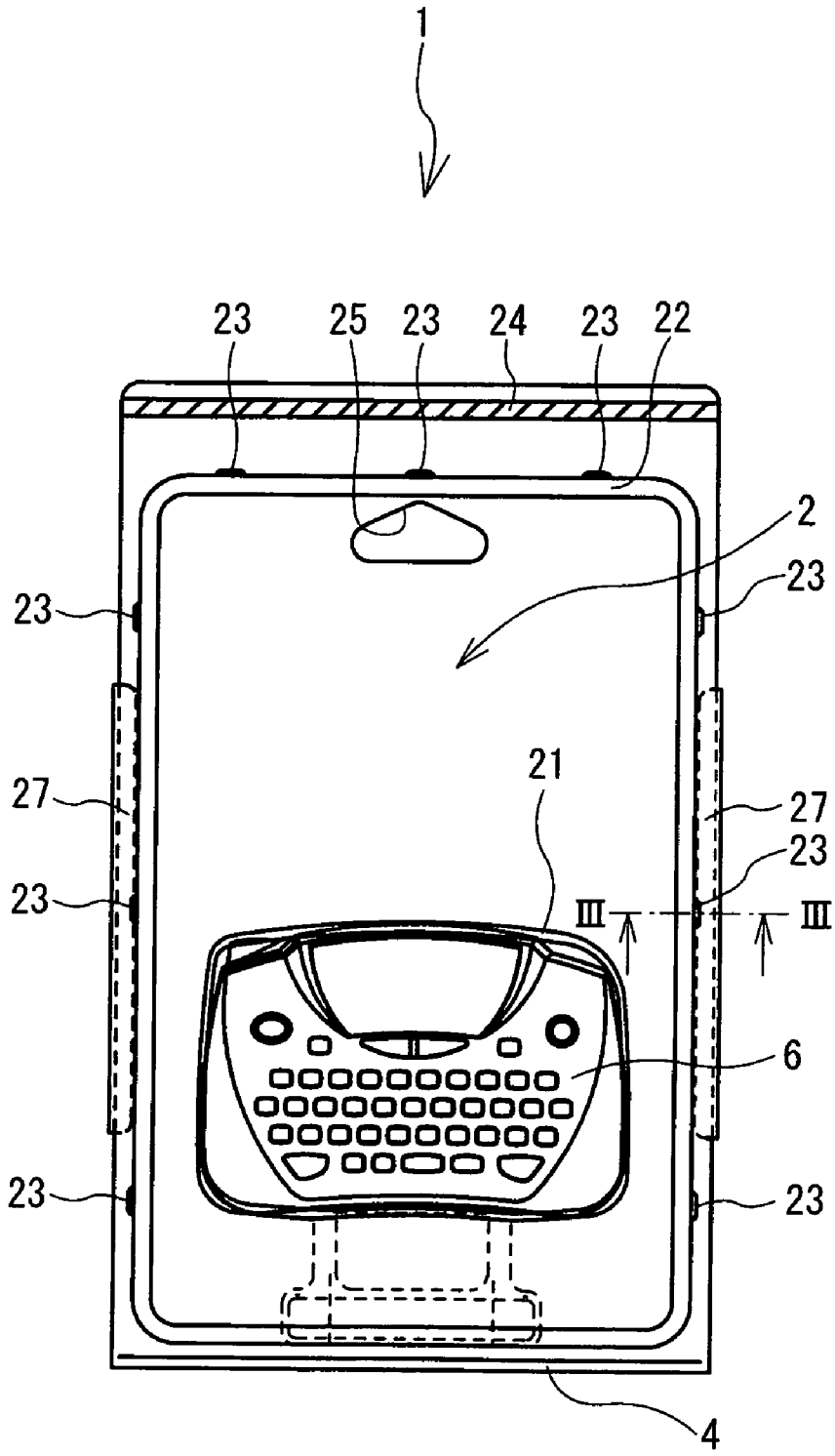
FIG. 9 is a front view of another clamshell packaging case as a variation.
Figure 10:
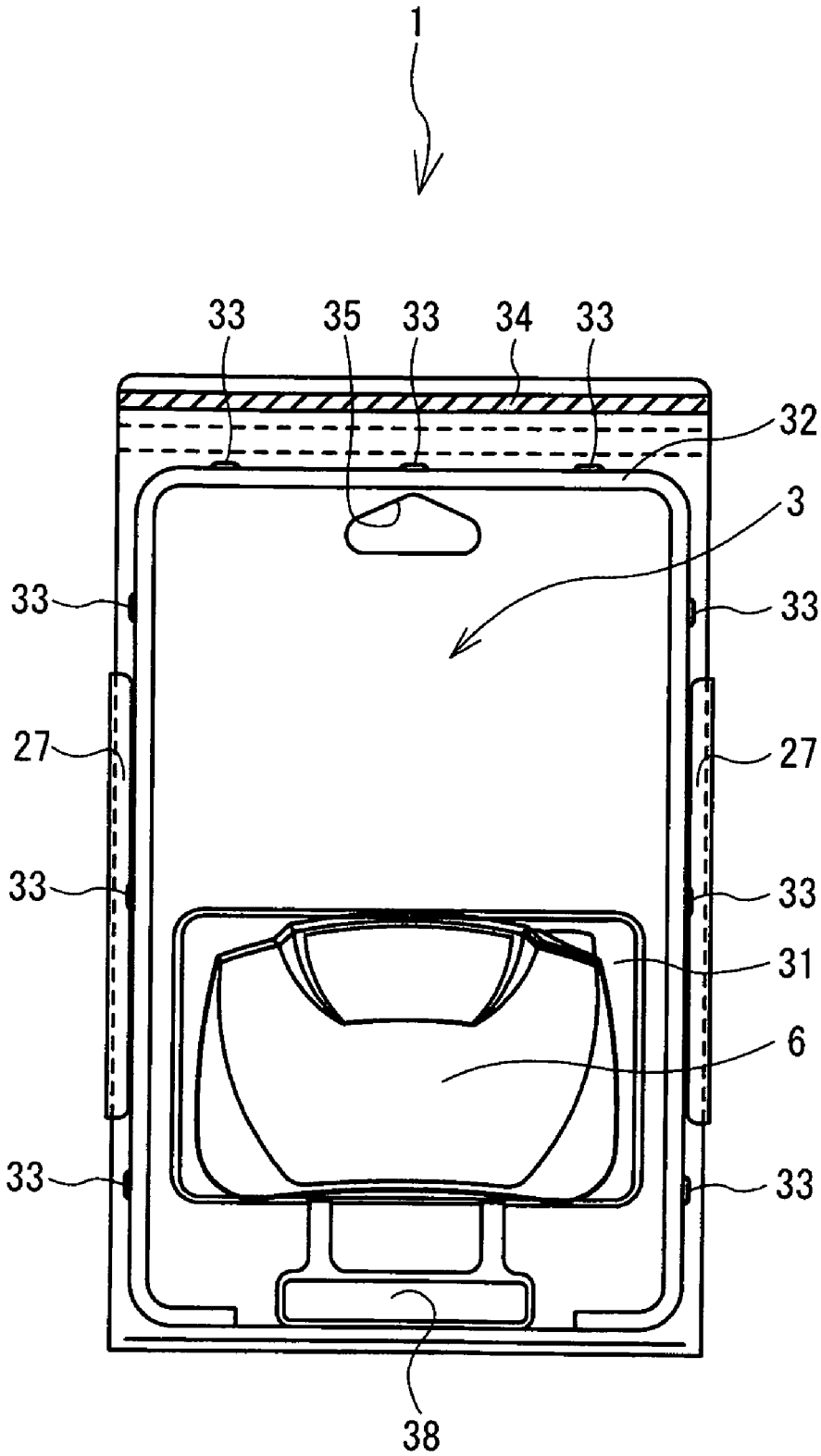
FIG. 10 is a rear view of the clamshell packaging case shown in FIG. 9.
Figure 11:
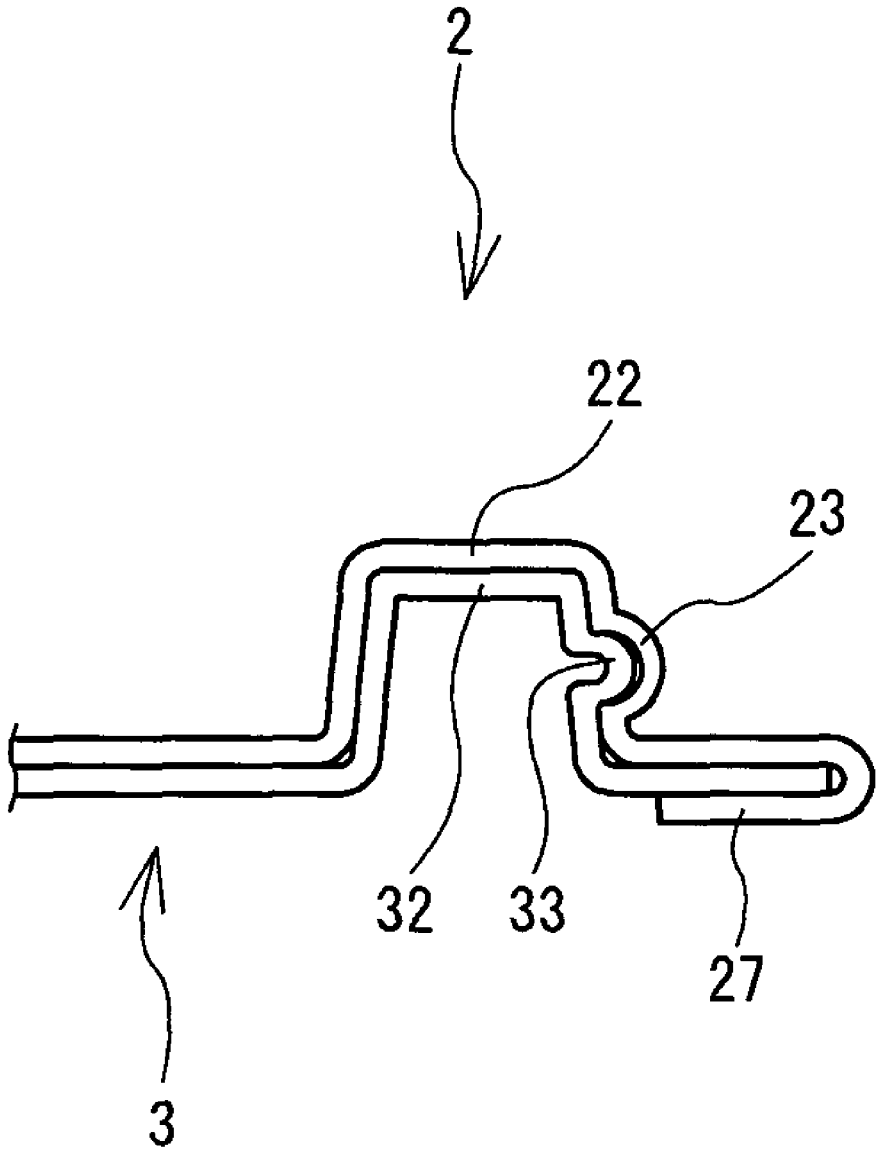
FIG. 11 is a cross-sectional view taken along line III-III in the direction indicated by arrows in FIG. 9.

Now, a variation of clamshell packaging case 1, which has the above described structure, is described in reference to FIGS. 9-11. This variation of clamshell packaging case 1 comprises fold parts 27 provided on the right and left edges of the first clamshell 2, each fold part having a predetermined length and a predetermined width and being folded over the rear side of the packaging case (side of the second clamshell 3) as shown in FIGS. 9-11. With the provision of these fold parts 27, now, the side edges of the second clamshell 3 are bound to the first clamshell 2 by the fold parts 27 as shown in FIG. 11, providing a protection against accidental opening. When the second clamshell 3 is to be separated from the first clamshell 2, these fold parts 27 are forcefully opened outward for disengaging the edges of the second clamshell 3 from the fold parts 27 of the first clamshell 2. Therefore, in the fitted condition where the first clamshell 2 and the second clamshell 3 are fitted to each other, the fold parts 27, 27 have a sufficient strength for maintaining the first clamshell 2 and the second clamshell 3 securely in their fitted condition, but these fold parts allow disengagement without resisting to the opening action taken by the user.

Figure 12:
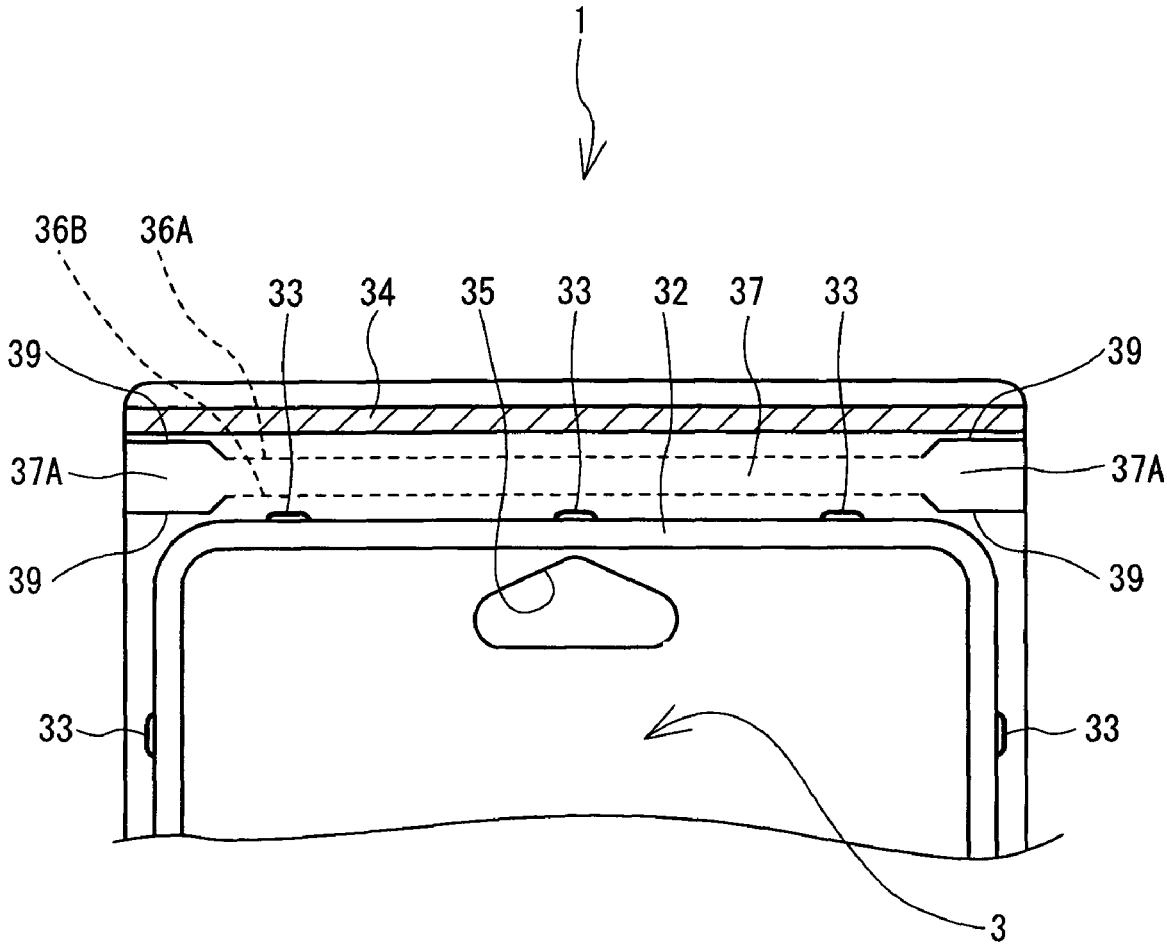
FIG. 12 is an enlarged partial view of an upper part of the rear side (second clamshell half) of a clamshell packaging case as a first alternative.

Now, a first variation of severed part 37 is described in reference to FIG. 12. In this variation, continuous cuts 39 each of which extends inward continuously for a predetermined length are provided at the right and left ends of the severed part 37, which is delimited by the two lines of perforations 36A, 36B and is positioned parallel to the sealed part 34 and adjacent to the upper edge of the second clamshell 3 as shown in FIG. 12. Furthermore, picking tabs 37A each of which is wider than the width defined by the two parallel lines of perforations 36A, 36B are provided at the right and left end parts of the severed part 37, where the end parts are delimited by the above mentioned continuous cuts 39. Therefore, the picking tabs 37A, which are delimited by the continuous cuts 39 with a predetermined length in advance, are easily picked and lifted, so the severed part 37 can be easily severed and removed.

Figure 13:
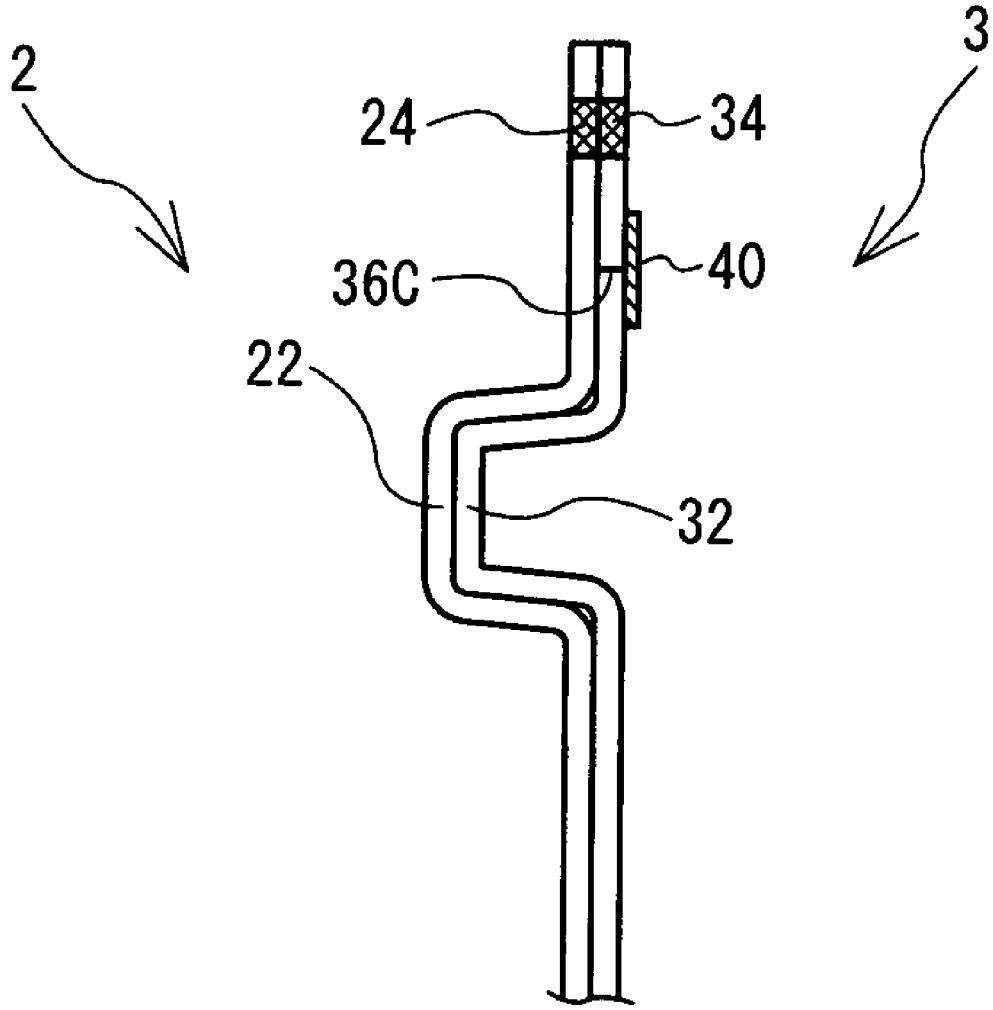
FIG. 13 is a cross-sectional view showing a fitted condition where the fitting groove of the first clamshell and the fitting convex part of the second clamshell of a second variation are fitted with each other and showing their sealed condition.

Now, a second variation of severed part 37 is described in reference to FIG. 13. As shown in FIG. 13 the second variation has no severed part 37 that is delimited by two lines of perforations 36A, 36B as described above at the part where the first clamshell 2 and the second clamshell 3 are in contact with each other. Instead, the second clamshell 3 is provided with a continuous cut 36C in advance at the part where it comes into contact with the first clamshell 2, and the cut 36C is closed and held by a strip of adhesive tape 40. In this design, for opening the clamshell packaging case 1, the tape 40 is removed, and then the second clamshell 3 is disengaged and separated from the first clamshell 2.

Figure 14:
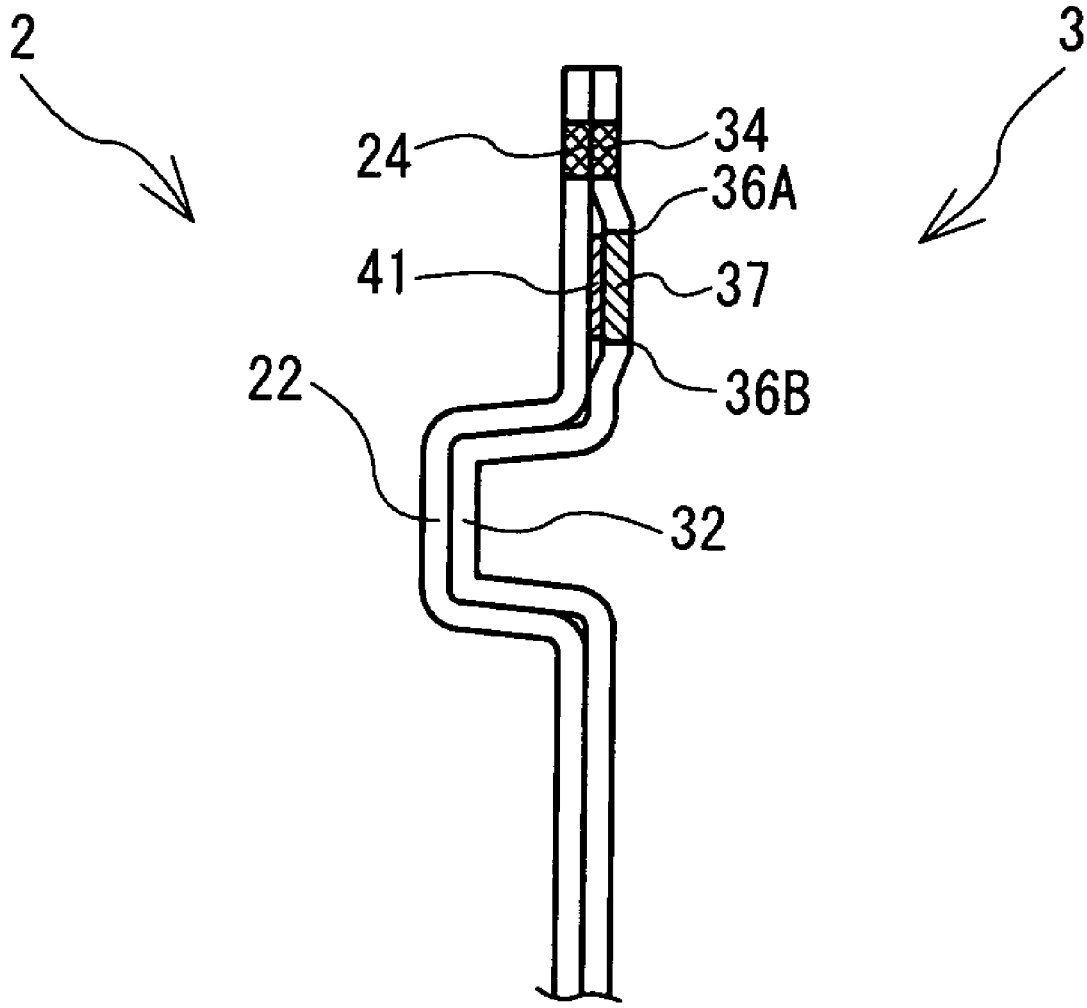
FIG. 14 is a cross-sectional view showing a fitted condition where the fitting groove of the first clamshell and the fitting convex part of the second clamshell of a third alternative are fitted with each other and showing their sealed condition.

Now, a third variation of severed part 37 is described in reference to FIG. 14. In this third variation, a strip of film 41 is provided between the severed part 37, which is delimited by the two lines of perforations 36A, 36B, and the first clamshell 2, in the condition where the first clamshell 2 and the second clamshell 3 are in contact with each other as shown in FIG. 14. In this variation, the strip of film 41 has the same length and approximately same width as the severed part 37 and extends along the severed part 37, for making the severing and removing of the severed part 37 easy along the lines of perforations 36A, 36B. When the clamshell packaging case is to be opened, this film is pulled along with the severed part. The pulling of the film facilitates the complete removal of the severed part. For this purpose, the film 41 has a tensile strength sufficient for withstanding the force applied for tearing off the severed part along the lines of perforations 36A, 36B, and it is made from such a material as synthetic resin, nylon, glass fiber or carbon fiber.

The present invention is not limited to the above described embodiments, and various modifications are possible. For example, in the above example, the clamshell packaging case 1 comprises the first clamshell 2 and the second clamshell 3 that are formed in a one-piece body. However, the first clamshell 2 and the second clamshell 3 can be each formed as a separate part and then joined to complete the clamshell packaging case 1. As an alternative, the first clamshell 2 and the second clamshell 3 may be welded both at their upper and lower edges. Furthermore, the two lines of perforations 36A, 36B and the severed part 37 may be provided, instead, to the first clamshell 2, which constitutes the front face of the clamshell packaging case 1. Moreover, the two lines of perforations 36A, 36B and the severed part 37 may be provided both at the upper and lower edges of the clamshell packaging case 1, respectively.

As described above, a packaging container according to the present disclosure comprises a severed part that is severed for opening the packaging container. As a result, a user can easily open the packaging container just by manually pulling and removing the severed part without using scissors or a cutter.

What is claimed is:

1. A packaging container comprising:

a first clamshell half, a second clamshell half, and a foldable connecting portion that connects one edge of the first clamshell half with one edge of the second clamshell half, a linearly extending welded portion defining a sealed portion that fastens the first clamshell half and the second clamshell half to each other, the sealed portion being located at and sealing only a second edge of the packaging container on a side opposite to the connecting portion at said one edge, a severed portion that is provided in at least one of the first clamshell half and the second clamshell half, adjacent to the sealed portion and between the sealed portion and said connection portion, wherein the severed portion is defined by two lines of perforations that are provided in parallel, at least one of the two lines of perforations is provided where the first clamshell half and the second clamshell half contact each other, a picking tab, adapted for being held by a user's fingers, provided at-least one of the ends of the lines of perforations in the direction where the lines of perforations delimiting the severed portion extend and that is defined by cuts which have a continuous, predetermined length, the picking tab having a width larger than the gap between the two parallel lines of perforations delimiting the severed portion;

a room created between the first clamshell half and the second clamshell half for accommodating a packaged object when the clamshell halves are fitted to each other;

U shaped fitting portions that are provided around the perimeter of the packaging container and make the first clamshell half and the second clamshell half fit against each other, wherein said first and second clamshell halves each include plural spaced convex and mating concave contours on an inner wall of said U shaped fitting portions, said contours enabling said first and second clamshell halves to engage each other when said first and second clamshell halves are fitted against each other.

2. The packaging container according to claim 1, further comprising a strip of film that is provided between the first clamshell half and the second clamshell half and along the severed portion, and that makes the severed portion to be tore off easily, which is delimited by the two parallel lines of perforations.

3. The packaging container according to claim 1, wherein the severed portion is provided in either one of the first clamshell half and the second clamshell half that forms a rear side of the packaging container.

* * * * *